US006613274B2

(12) United States Patent
Dawson

(10) Patent No.: US 6,613,274 B2
(45) Date of Patent: Sep. 2, 2003

(54) CAST IRON ALLOY AND METHOD OF MAKING THE SAME

(75) Inventor: Steve Dawson, Twickenham (GB)

(73) Assignee: Sintercast AB, Stockholm (SE)

( * ) Notice: Subject to any disclaimer, the term of this patent is extended or adjusted under 35 U.S.C. 154(b) by 0 days.

(21) Appl. No.: 10/151,933

(22) Filed: May 22, 2002

(65) Prior Publication Data

US 2003/0005979 A1 Jan. 9, 2003

Related U.S. Application Data

(63) Continuation of application No. PCT/SE00/02295, filed on Nov. 22, 2000.

(30) Foreign Application Priority Data

Nov. 23, 1999 (SE) ..... 9904257

(51) Int. Cl.[7] ..... C22C 37/00

(52) U.S. Cl. ..... 420/26; 420/13; 420/15; 148/321

(58) Field of Search ..... 420/26, 13, 15; 148/321

(56) References Cited

U.S. PATENT DOCUMENTS

| | | | | |
|---|---|---|---|---|
| 2,485,761 A | | 10/1949 | Millis et al. | |
| 2,488,511 A | | 11/1949 | Morrogh | |
| 4,227,924 A | * | 10/1980 | Subramanian et al. | 148/321 |
| 4,409,028 A | | 10/1983 | Moore | |
| 5,858,127 A | | 1/1999 | Ott et al. | |

FOREIGN PATENT DOCUMENTS

| | | |
|---|---|---|
| EP | 769 615 | 4/1997 |
| GB | 1069058 | 5/1967 |
| WO | WO 93/20960 | 10/1993 |
| WO | WO 99/25888 | 5/1999 |
| WO | WO 99/28726 | 6/1999 |
| WO | WO 00/37699 | 6/2000 |

OTHER PUBLICATIONS

"Standard Method for Evaluating the Microstructure of Graphite in Iron Castings"; ANSI/ASTM A 247–67 (Reapproved 1978) pp. 12–13 No Month.

Excerpt from: Iron Castings Handbook, C.F.Watson and T.J.Opar, (Eds) Iron Castngs Society, 1981, pp. 144–147. No Month.

"Cast Iron—Designation of microstructure of graphite", ISO 945–1975 pp. 1–8 No Date.

Patent Abstracts of Japan—Asakura Yoji et al: "Spheroidal Graphite Cast Iron Parts and Production Thereof" Application No.: 04257955, published Apr. 19, 1994.

SAE Technical paper No. 99P–144. vol., 1999, Robert J. Warrick et al, "Development and of Enhanced Compacted Graphite Iron for the Bedplate of the New Chrysler 4.7 Liter V–8 Engine" p. 1–p. 10 No Month.

* cited by examiner

*Primary Examiner*—Roy King
*Assistant Examiner*—Andrew Wessman
(74) *Attorney, Agent, or Firm*—Pillsbury Winthrop LLP

(57) ABSTRACT

The invention provides a cast iron alloy comprising 3.0–3.8% carbon, 06–25% silicon, 0.2–0.65% manganese, 0.01–0.1% tin, <0.025% sulfur, 0.001–0.020% magnesium, 0.1–1.2% copper, 0.04–0.2% chromium, and balance up to 100% of iron and incidental impurities. The matrix structure is a continously variable ferrite/pearlite mixture and the content of carbides is less than 1%. The graphite shape of the alloy is 1 50% flake graphite, 50–99% compacted graphite and at most 10% spheroidal graphite. Such an alloy is easier to machine and less prone to shrinkage than an ordinary compacted graphite cast iron.

6 Claims, 4 Drawing Sheets

Fig. 4B
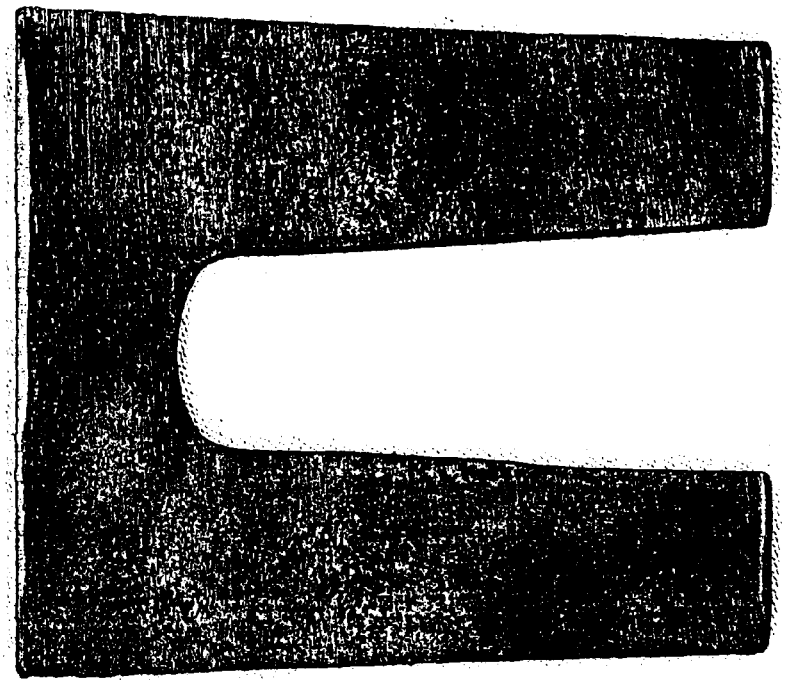
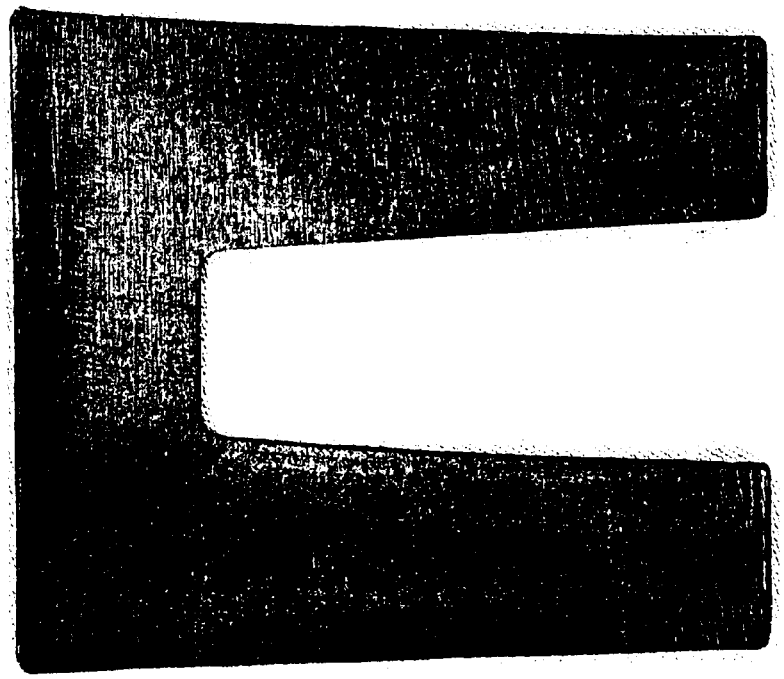
Fig. 4A

CAST IRON ALLOY AND METHOD OF MAKING THE SAME

This is a Continuation of International Application No. PCT/SE00/02295 filed Nov. 22, 2000 which designated the U.S.

FIELD OF THE INVENTION

The present invention relates to a novel cast iron alloy whose microstructure comprises compacted graphite and flake graphite. The invention also relates to using the novel cast iron alloy in the production of a cylinder block, a cylinder head, a bed plate, a transmission housing or an axle housing.

TECHNICAL BACKGROUND

Cast irons are widely used for a variety of applications. The basic types of cast iron can be categorised as:

Grey cast iron, where the graphite exists as flakes or lamellar particles.

Compacted graphite iron (CGI), where the graphite particles are elongated as in grey iron but are shorter and thicker and have rounded edges and irregular bumpy surfaces.

Ductile iron, where the graphite precipitates as individual spheroids or nodules, and Malleable iron, where the graphite particles precipitate from the solid state during heat treating operation.

The production, properties and applications of these irons is documented in, for example, the *Iron Casting Handbook* C. F. Walton (Editor), Iron Castings Society, and specified in the ASTM A 247 and ISO 945-1975 standards.

Until about 1960, the standards focused primarily on grey cast iron. Ideally, grey cast iron should contain long and randomly oriented graphite flakes or lamellae. However, degenerate graphite shapes may also grow under certain conditions. The grey iron terminology therefore refers to five different types of grey iron ranging from Type A to Type E. Type A graphite denotes long graphite flakes and is preferred in most applications while Types B through E are degenerate and result in lower strength. With the introduction of ductile iron in 1948, the standards were amended to include the new and different forms of graphite. The ASTM standard adopted seven different types of graphite. Type I represented ideal graphite nodules while Types II through VI showed various types of degenerate nodules. Type VII was reserved for grey iron, which then was subdivided into the established categories A through E. The ISO standard has a similar approach with only six basic forms of graphite. Form I is grey iron and Form VI represents ideal graphite nodules. Forms II through V refer to degenerate forms of nodules. Similar to the ASTM standard, ISO Form I for grey iron is sub-divided into Categories A through E to show the various types of grey iron. The definitions of A through E are common in ISO and ASTM.

As a result of the evolution of the microstructure rating standards, two entirely separate rating techniques have evolved. Grey iron is defined by reference to the different types A through E, for example, 90% Type A plus 10% Type B. Ductile iron is classified in terms of percent nodularity, that is, what percent of the graphite particles are present as perfect nodules. Commercial ductile irons must generally have more than 85% nodularity (i.e., more than 85% ASTM type I graphite or ISO Form VI graphite). Microstructure rating charts ranging from 50–100% nodularity have been widely published to assist in microscope evaluations of graphite shape.

Both the ASTM and the ISO standards include a reference to compacted graphite. Compacted graphite is represented by ISO Form III or ASTM Type IV graphite. High quality CGI should generally have more than 80% compacted graphite particles with less than 20% nodular graphite and no flake graphite. Thus, for compacted graphite iron, the industry has accepted a specification of 0–20% nodularity.

Therefore, based on the ASTM and ISO standards, a continuum has been established from perfect CGI (100% ISO Form III or 100% ASTM Type IV) to perfect ductile iron (100% ISO Form VI or 100% ASTM Type I). A nodularity scale of 0–100% is thus established, but this scale completely excludes grey cast iron. For metallurgists, grey cast iron exists on a separate "A through E" scale below 0% nodularity.

Until now, the vast majority of iron castings are specified in one of the above cast iron types with particular requirements for microstructural homogeneity to unify properties throughout the casting. More recently, it has been proposed that some products may benefit from the presence of different types of graphite in different areas of the casting. In this way, the mechanical and physical properties of a given type of cast iron can be exploited in the specific regions of the casting that best benefit from those properties. Specific examples include cylinder blocks that contain flake graphite or compacted graphite in the cylinder bores for heat transfer and friction behaviour and spheroidal graphite in the structural regions for rigidity and durability (EP 0769615 Al and JP 6-106331), or a flywheel that has CGI in the perimeter for machinability and spheroidal graphite in the hub for strength (WO 93/20969). Many other such examples can be cited. The concept of different graphite types in different areas of cast iron castings has not been widely accepted due to the difficulties to reliably control the production method. Indeed, it is easier to have uniform graphite throughout the casting, and easier to target the middle range of wide microstructure specifications in order to minimize foundry rejects caused by out-of-specification products. While these traditional practices facilitate foundry production, they do not always provide optimal properties and products.

In response to the ever-increasing demand for higher torque, reduced emissions and improved fuel economy, engine designers are forced to seek stronger materials for cylinder block construction. This fact is particularly true in the diesel sector where emissions and torque objectives can only be met by increasing peak cylinder combustion pressures. While today's direct-injection passenger car diesels operate at approximately 135 bar, the next generation of DI diesels is targeting 160 bar and beyond. Peak combustion pressures in heavy duty truck applications are already exceeding 200 bar. At these operating levels, the strength, stiffness and fatigue properties of grey cast iron and the common aluminum alloys may not be sufficient to satisfy performance packaging and durability criteria. Engine designers are therefore exploring alloyed grey cast irons and CGI to extend the operating range of their designs. In many cases, the strength of alloyed grey iron may not be sufficient while that of CGI may be more than is required. Conventional (5–20% nodularity) CGI can also be prone to shrinkage defects in complex castings.

In addition to strength limitations of approximately 300 MPa, alloyed grey irons are difficult to machine and frequently crack during shake-out, cooling and handling. The high alloy content also restricts recycling of returns within the foundry.

While 5–20% nodularity compacted graphite iron has more-than-adequate strength, it's application may be limited by machining, particularly the high speed cylinder boring operation. The thermal conductivity of CGI, being approximately 20% lower than that of grey iron can also be problematic in some designs. Another problem that may occur when casting CGI is shrinkage. A casting that has undergone shrinkage may have internal porosity or surface depressions requiring that these castings be discarded. Even worse, the internal shrinkage porosity may not be observed during quality inspection and finished products made from such castings would be prone to premature failure in service.

Accordingly, there is a need for a material which is sufficiently strong to fulfil the increased strength demand, and which is less prone to shrinkage.

When the magnesium treatment of compacted graphite iron is insufficient to stabilize a fully compacted graphite morphology, the graphite may begin to grow with a flake graphite morphology. As the solidification of each eutectic cell progresses radially outward, the magnesium concentration segregates ahead of the solidification front. The magnesium may become sufficiently high to stabilize compacted graphite iron around the perimeter of the eutectic cell. The resultant microstructure is referred to herein as flake-patch CGI (FIG. 1). It is well known that these flake patches cause a precipitous decrease in the tensile strength and stiffness of CGI. For this reason, several authors have clearly shown that flake patches must be avoided in castings designed for CGI (C. R. Reese and W. J. Evans: Development of an inmold treatment process for compacted graphite iron cylinder blocks, AFS Annual Foundry Congress, Atlanta, 1998. Also, R. J. Warrick et al: Development and application of enhanced compacted graphite iron for the bedplate of the new Chrysler 4.7 liter V-8 engine, SAE Paper No. 99P-144).

SUMMARY OF THE INVENTION

It has now turned out that the above mentioned strength and shrinkage problems can be solved by providing a cast iron alloy having the following characteristics:

| | |
|---|---|
| Graphite shape: | 1–50% flake graphite. 50–99% compacted graphite and at most 10% spheroidal graphite; |
| Matrix structure: | continously variable ferrite/pearlite mixture, as desired; and |
| Carbides: | less than 1%. |

A representative chemical specification for such an alloy is 3.0–3.8% carbon, 1.6–2.5% silicon, 0.2–0.65% manganese, 0.01–0.1% tin, <0.025% sulfur, 0.001–0.020% magnesium, 0.1–1.2% copper, 0.04–0.2% chromium, and balance up to 100% of iron.

BRIEF DESCRIPTION OF THE DRAWINGS

The present invention will now be described with reference to the enclosed figures, in which:

FIG. 4 discloses the problem of surface shrinkage. A cast iron melt was poured into a mold suitable for producing a casting having a flat central recess. FIGS. 4A and 4B discloses cross-sections of such castings. As is shown in FIG. 4B, the shrinkage behaviour has caused the solidified casting to have a deeper than desired and concave-shaped (instead of flat) central recess. In contrast, FIG. 4A discloses a casting according to the present invention with a correct central recess.

DETAILED DESCRIPTION

The presence of flake patches in a fully pearlitic CGI microstructure reduce the tensile strength from approximately 450 MPa to approximately 350 MPa. In a CGI design this will certainly lead to premature failure. However, the strength level of 350 Mpa still represents a 40% increase relative to conventional grey cast iron (GG 25 according to the DIN 1691 specification), and also meets or exceeds the tensile limit of alloyed grey irons.

Figure 1:
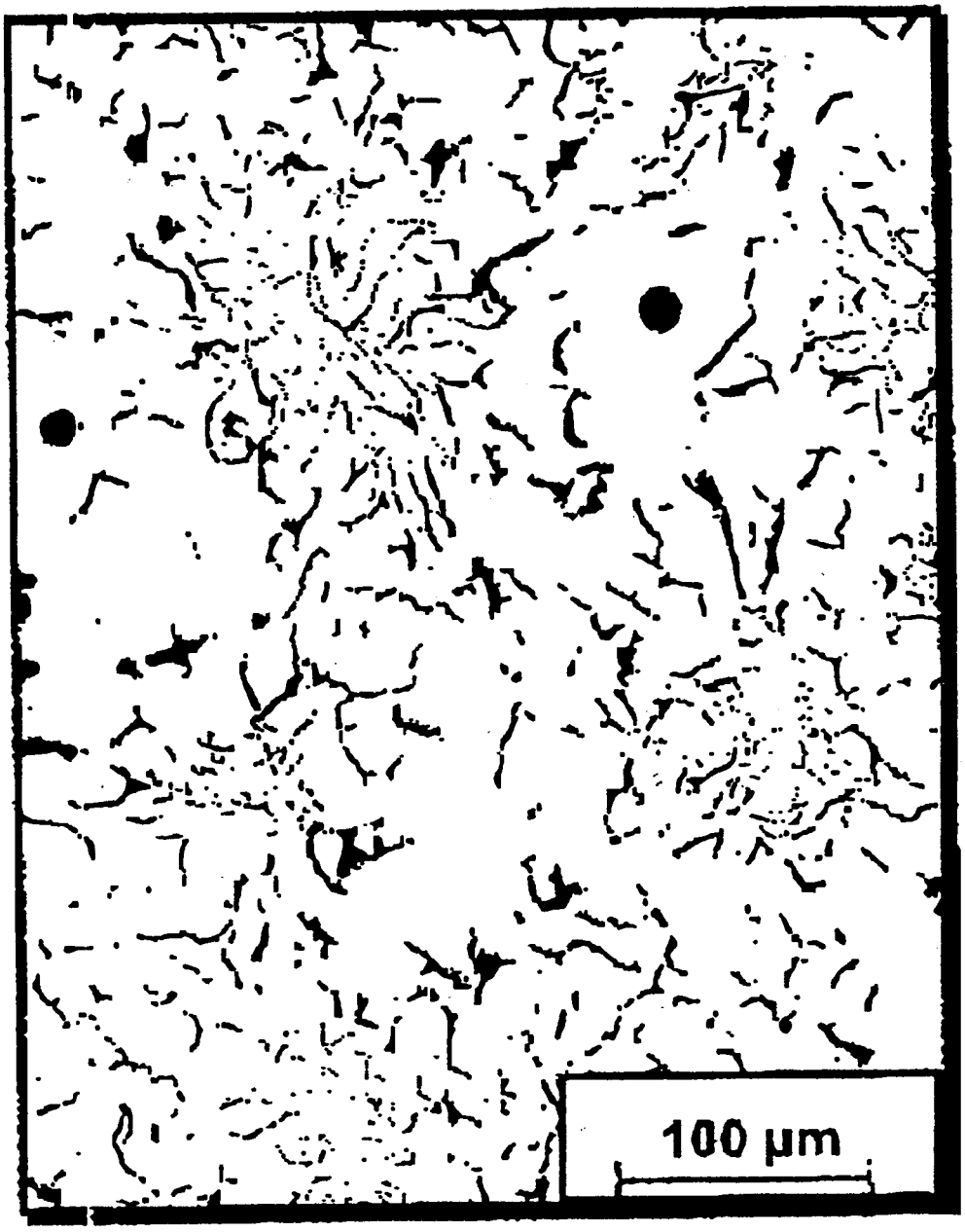
FIG. 1 is a micrograph showing a cast iron alloy according to the present invention. The graphite microstructure of this alloy comprises 40% thin lamellae of flake graphite (flake patches) and 60% compacted graphite.
Figure 2:
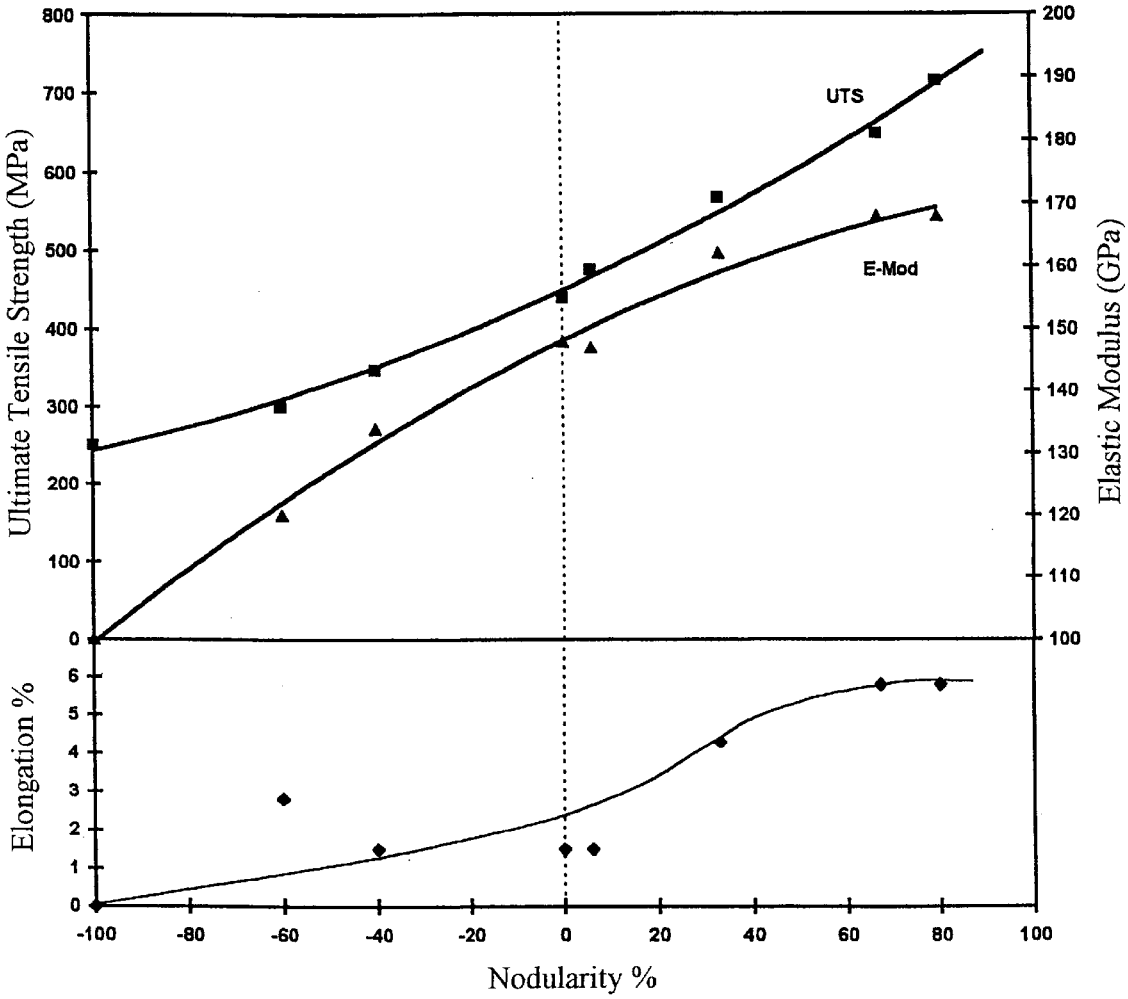
FIG. 2 is a diagram showing the ultimate tensile strength, the elastic modulus and the elongation as a function of nodularity.

As shown in FIG. 2, although the tensile strength and stiffness of CGI decrease with the onset of flake graphite formation, the elongation is not adversely affected. The fact that the flake patches are perimeter-surrounded by compacted graphite particles reduces crack initiation and propagation and imposes a ductile rather than brittle failure mode. While a cast iron microstructure comprising a mixture of flake patches and compacted graphite provides 1–3% elongation, grey iron and alloyed grey irons have effectively no ductility. This combination of strength and ductility opens many application opportunities.

As already mentioned, the invention provides a new cast iron alloy having the following composition:

| | |
|---|---|
| Graphite shape: | 1–50% flake graphite, 50–99% compacted graphite and at most 10% spheroidal graphite; |
| Matrix structure: | continuously variable ferrite/pearlite mixture, as desired; and |
| Carbides: | less than 1%. |

Preferably, the graphite shape of the cast iron alloy is 1–10% flake graphite, 90–99% compacted graphite and at most 5% spheroidal graphite. Still more preferably the graphite shape of the cast iron alloy is 1–10% flake graphite, 90–99% compacted graphite and at most 1% spheroidal graphite. The percentages disclosed herein in relation to graphite shape relates to the relative amounts of graphite particles in the cast iron that are present as flake graphite and compacted graphite, respectively.

This microstructure can be produced at a variety of chemical compositions, and the chemical specification would therefore be subordinate to microstructure and properties. Nonetheless, a representative chemical specification for the preceding flake-patch alloy would be:

| | |
|---|---|
| Carbon: | 3.0–3.8%, preferably 3.5–3.7%; |
| Silicon: | 1.6–2.5%, preferably 2.1–2.4%; |
| Manganese: | 0.2–0.65%, preferably 0.3–0.5%; |
| Tin: | 0.01–0.1%; |

-continued

| | |
|---|---|
| Sulfur: | <0.025%; |
| Magnesium: | 0.001–0.020%; |
| Copper: | 0.1–1.2%; |
| Chromium: | 0.04–0.2%; |
| Iron: | balance up to 100%. |

Other tramp elements would be within the normal range for compacted graphite iron or ductile iron production, known per se. The alloy could be used in a variety of applications including cylinder heads, cylinder blocks, bedplates and various housings as required. One of the most significant advantages of the new alloy is a considerably increased magnesium control range. The stable Mg-range is up to 2.5 times larger than that of conventional CGI (5–20% nodularity) and appoximately as large as that of ductile iron.

Despite the fact that the present invention aims at producing a cast iron alloy having a graphite microstructure comprising flake graphite and compacted graphite, some spheroidal graphite will always be formed in regions between the eutectic solidification cells. Cast iron melts do not solidify homogenously. The positive segregation of magnesium ahead of the solid-liquid interface results in a gradual build-up of magnesium in the liquid phase. Ultimately, the local magnesium concentration between the solidification cells may become sufficiently high that spheroidal graphite will be formed.

As already mentioned, the alloy of the invention is significantly less prone to shrinkage, either external or internal, than CGI, ductile iron or alloyed grey iron. Solidification, both internal (porosity) and external (surface depression) is caused by redistribution of metal and/or contraction during the final stages of solidification. Specifically, thin sections of the casting solidify relatively quickly and tend to pull the liquid iron from neighbouring thick sections as they solidify and contract. These shrinkage forces can leave void spaces in the slow cooling areas (internal porosity) and create surface depressions in the contracting regions.

Accordingly, the geometry of a cast component is important when evaluating the risk of incurring shrinkage defects. Complex castings, such as cylinder blocks typically have many regions where thin (3–5 mm) sections are directly connected to relatively thick (>10 mm) sections. Such geometries are difficult to cast with either alloyed grey iron or conventional (5–20%) CGI because the presence of the alloying elements (Cr and Mo for example in alloyed grey iron, or higher Mg in conventional CGI) extend the solidification range and thus allow more time for the shrinkage phenomenon to develop. However, such problems do not occur when using the cast iron alloy of the present invention.

In a comparison to CGI and alloyed grey cast irons, a cast iron with combined flake and compacted graphite would provide:

| Benefit of New Alloy | Alloyed vs. Grey Iron | Compacted vs. Graphite Iron |
|---|---|---|
| Larger stable production range | No | Yes |
| Equal or higher tensile strength | Yes | No |
| Equal or higher elastic modulus | Yes | No |
| Equal or higher elongation | Yes | Yes |
| Equal or higher castability | Yes | Yes |

-continued

| Benefit of New Alloy | Alloyed vs. Grey Iron | Compacted vs. Graphite Iron |
|---|---|---|
| Equal or higher machinability | Yes | Yes |
| Less or equal shrinkage | Yes | Yes |
| Less or equal casting defects | Yes | Yes |
| Better casting yield | Yes | Yes |
| Less alloy usage | Yes | Yes |
| Better internal recycling | Yes | Yes |

Figure 3A:
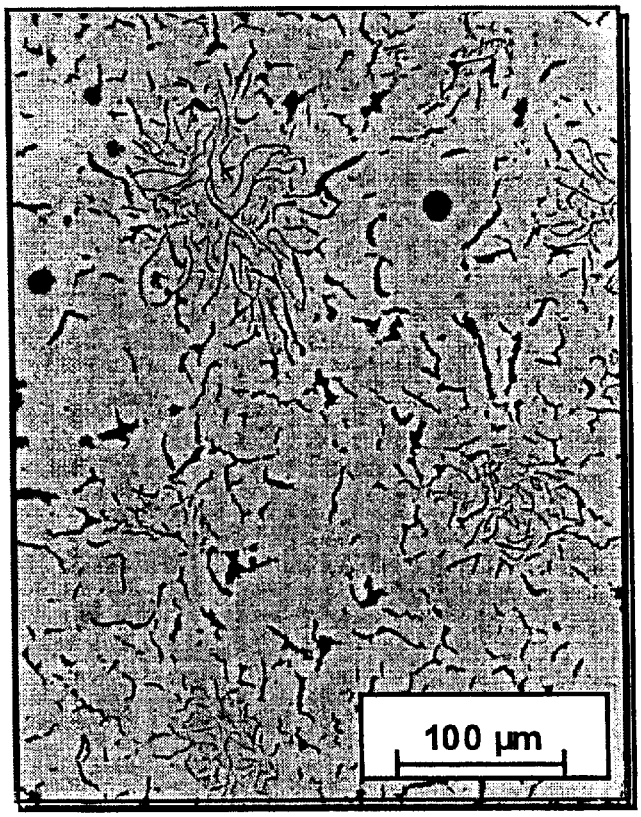
FIG. 3 shows the importance of a good process control when producing CGI. An addition of 0.001% active Mg is sufficient to convert a cast iron microstructure with 50% flake patches and 50% compacted graphite according to the present invention (FIG. 3*a*) (ultimate tensile strength 325 MPa) into an optimal CGI structure with approximately 3% nodularity CGI (ultimate tensile strength: 450 MPa)(FIG. 3*b*)
Figure 3B:
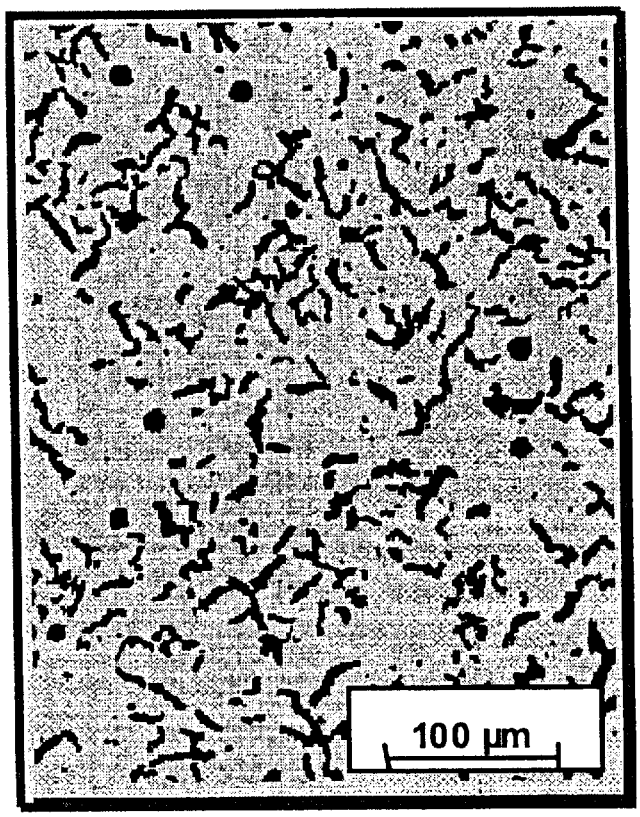

An accurate process control is certainly required to ensure the optimal amount of flake graphite. The transition from a fully compacted graphite (5% nodularity, no flake) to a CGI alloy containing 30% flake graphite can occur with the loss of as little as 0.001% Mg. This is shown for samples produced in a 30 mm diameter test bar poured from a 1 tonne ladle in a production foundry, in FIG. 3. The level of inoculant also has a significant effect on the ultimate graphite microstructure. For these reasons, it is important that the molten iron be carefully prepared, treated and controlled to ensure that neither an excess of flake graphite, nor an excess of CGI or nodularity are formed. Excess flake graphite will result in insufficient mechanical properties while excess CGI or nodularity will result in insufficient physical properties, castability kind machinability. This is particularly important at the higher carbon contents advocated in the alloy of the present invention, as a fully flake-type iron at a carbon content of 3.6–3.8% may have a tensile strength less than 200 Mpa.

The present alloy relies upon the teachings of WO 99125888, WO 00/37699 and PCT/SE98/02122 to reliably control the iron within the necessary range. The minimisation of magnesium, together with controlled inoculant and carbon equivalent levels, result in a strong solidification skin which resists expansion and contraction forces and thus prevents shrinkage. This capability allows the alloy and the method of the present invention to be successfully used for the high volume production of complex castings, such as engine blocks and cylinder heads.

What is claimed is:

1. A cast iron alloy comprising 3.0–3.8% carbon by mass, 1.6–2.5% silicon by mass, 0.2–0.65% manganese by mass, 0.01–0.1% tin by mass, <0.025% sulfur by mass, 0.001–0.020% magnesium by mass, 0.1–1.2% copper by mass, 0.04–0.2% chromium by mass, and balance up to 100% of iron and incidental impurities by mass, wherein the matrix structure is a continuously variable ferrite/pearlite mixture, wherein the content of carbides is less than 1% by mass, and wherein the graphite shape of the alloy is 1–50% flake graphite, 50–99% compacted graphite and at most 10% spheroidal graphite, given as percentages of the relative amounts of graphite particles in the cast iron alloy that are present as flake graphite and compacted graphite, respectively.

2. A cast iron alloy according to claim 1, wherein the carbon content is 3.5–3.7% by mass.

3. A cast iron alloy according to claim 1, wherein the silicon content is 2.1–2.4% by mass.

4. A cast iron alloy according to claim 1, wherein the manganese content is 0.3–0.5% by mass.

5. A cast iron alloy according to any one of claims 1–4, wherein the graphite shape of the alloy is 1–10% flake graphite, 90–99% compacted graphite and at most 5% spheroidal graphite, given as percentages of the relative amounts of graphite particles in the cast iron alloy that are present as flake graphite and compacted graphite, respectively.

6. A east iron alloy according to claim 5, wherein the graphite shape of the alloy is 1–10% flake graphite, 90–99% compacted graphite and at most 1% spheroidal graphite, given as percentages of the relative amounts of graphite particles in the cast iron alloy that are present as flake graphite and compacted graphite, respectively.

* * * * *